United States Patent [19]

Olwert et al.

[11] Patent Number: 5,019,743

[45] Date of Patent: May 28, 1991

[54] MOUNT STRUCTURE FOR DOUBLE ENDED LAMP

[75] Inventors: Ronald J. Olwert, Concord Township, Lake County; Frank E. Zalar, Euclid; Walter R. Chapman, Jr., Cleveland Heights, all of Ohio

[73] Assignee: General Electric Company, Schenectady, N.Y.

[21] Appl. No.: 439,113

[22] Filed: Nov. 17, 1989

[51] Int. Cl.[5] ..... H01J 5/46; H01K 1/22

[52] U.S. Cl. ..... 313/25; 313/269; 313/292; 313/315

[58] Field of Search ..... 313/25, 332, 357, 579, 313/623, 561, 331, 113

[56] References Cited

U.S. PATENT DOCUMENTS

| | | | |
|---|---|---|---|
| 4,322,248 | 4/1982 | Patrician et al. | 313/557 |
| 4,389,201 | 6/1983 | Hamster et al. | 445/26 |
| 4,524,302 | 6/1985 | Berlec | 313/579 |
| 4,743,803 | 5/1988 | Lanese et al. | 313/579 |
| 4,754,373 | 6/1988 | Otto et al. | 362/61 |
| 4,755,712 | 7/1988 | Mujahid et al. | 313/332 |
| 4,758,759 | 7/1988 | Scholz et al. | 313/25 |
| 4,810,932 | 5/1989 | Ahlgren et al. | 313/579 |

*Primary Examiner*—Donald J. Yusko
*Assistant Examiner*—John E. Giust
*Attorney, Agent, or Firm*—Edward M. Corcoran; Stanley C. Corwin; Fred Jacob

[57] ABSTRACT

An elongated tubular lamp such as an arc lamp or tungsten halogen lamp mounted in a reflector or lamp mount by means of a long and a short mount wire is more resistant to breaking off the mount wires if the short mount wire is smaller in diameter than the long mount wire, but not smaller than the diameter of the lamp lead wire to which it is welded in combination with the lamp lead wire being molybdenum alloy having a recrystallization temperature at least about 200° C. higher than molybdenum.

12 Claims, 1 Drawing Sheet

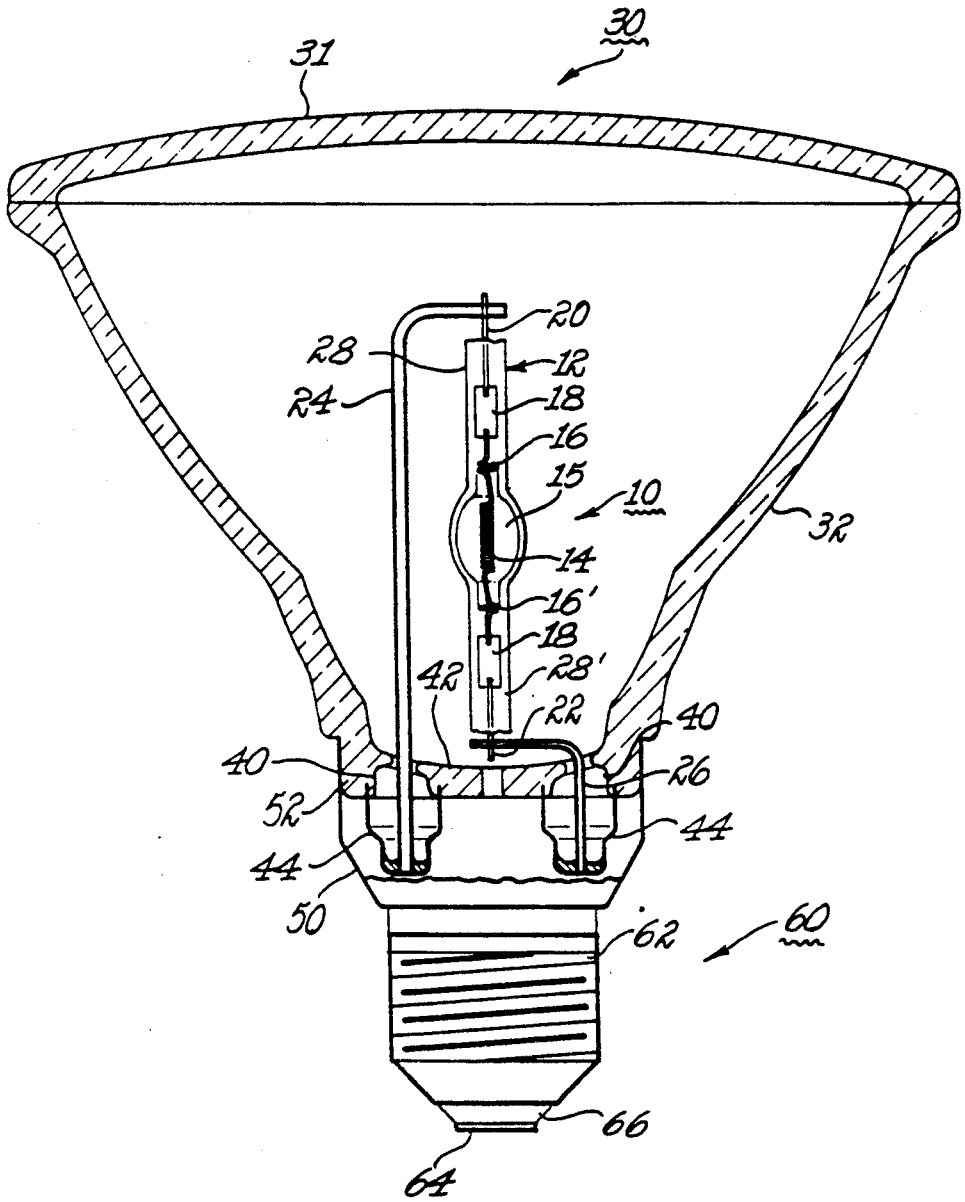
30
31
20
28
12
24
18
16
15
10
32
14
16'
18
28'
42
22
40
40
26
52
44
44
50
62
60
66
64

MOUNT STRUCTURE FOR DOUBLE ENDED LAMP

BACKGROUND OF THE INVENTION

1. Field of the Invention

This invention relates to a mount structure for a double ended lamp having improved resistance to breaking under impact stress. More particularly, this invention relates to supporting a longitudinally aligned double ended lamp in a reflector by means of a long and short mount wire welded to respective ones of the two lamp inlead wires, wherein the cross section of the short wire is smaller than that of the long wire, but not smaller than that of the lamp inlead wire and wherein the lamp inlead wire welded to the short mount wire is molybdenum which has been alloyed to have a recrystallization temperature at least about 200° C. higher than molybdenum wire without such alloying.

2. Background of the Disclosure

Double ended lamps comprising a generally tubular vitreous envelope enclosing either a filament or electrodes within and being hermetically sealed at both ends are well known to those skilled in the art.

Such lamps include filament-halogen lamps which are generally made of a quartz tube enclosing a tungsten filament within a filament chamber and hermetically sealed on both ends by means of a pinch or shrink seal over a molybdenum foil seal assembly. One or more halogens are sealed within the filament chamber whose surface may or may not contain a coating or filter which transmits and/or reflects selective portions of light radiation emitted by the filament. Also included are arc lamps wherein the quartz tube contains two electrodes hermetically sealed within an arc chamber which also contains one or more metal halides. Such lamps are able to produce considerably more light output than ordinary incandescent lamps and are particularly useful in relatively small sizes enclosed in reflector assemblies for use in general indoor, outdoor and automotive lighting.

These lamps, when mounted in lamp reflectors, have exhibited problems of breakage when subjected to impact stresses during shipping and in automotive applications, particularly when the longitudinal axis of the lamp is aligned with the longitudinal axis of the reflector so that a long and short mount wire must be employed within the reflector assembly in order to secure the lamp. The outer lead wires of these lamps are made of molybdenum for various reasons. The mount wires used to secure the lamp are welded to the molybdenum lamp outer lead wires protruding outwardly from each end of the lamp by known means such as arc welding, laser welding, resistance welding, etc. The welding operation results in localized stresses and recrystallization of the molybdenum lamp lead wires at the point of welding. Recrystallization of the molybdenum wire has been found to result in increased breaking of the outer lamp lead just above the point at which it is welded to the shorter mount wire.

SUMMARY OF THE INVENTION

It has now been discovered that a double ended lamp mounted in a reflector, with its longitudinal axis aligned with the longitudinal axis of the reflector, by means of a long and a short mount wire welded to respective ones of a molybdenum outer lead wire of the lamp, has improved resistance to breaking under impact stress when the short mount wire is smaller in cross-section than the long mount wire, but no smaller in cross-section than the lamp inlead wire to which it is welded, in combination with said molybdenum lamp inlead wire being alloyed to have a recrystallization temperature of at least about 200° C. higher than molybdenum would ordinarily have. Thus, in one embodiment the present invention relates to a combination of a double ended lamp assembled into a reflector assembly, wherein said lamp comprises a light transmissive envelope containing an electric light source within and having two outer leads electrically connected to said light source which extend outwardly from each end of said lamp, with said lamp mounted so that its longitudinal axis is coincident or aligned with the longitudinal axis of said reflector by means of two mount wires, a long mount wire and a short mount wire each welded to a respective one of said lamp lead wires, with said short mount wire being smaller in cross-section than said long mount wire, but no smaller in cross-section than said lamp outer lead wire, said lamp lead wire being molybdenum wire alloyed with minor amounts of alloying metal so as to have a recrystallization temperature at least about 200° C. higher than molybdenum. Minor amounts of Al, Si and K have been found suitable for raising the recrystallization temperature of molybdenum wire. Molybdenum wire being alloyed with minor amounts of Al, Si and K and having a recrystallization temperature at least about 200° C. higher than molybdenum and being suitable for use as lamp outer leads in accordance with the practice of this invention is commercially available from GE Lighting in Cleveland, Ohio as their KW Mo wire.

BRIEF DESCRIPTION OF THE DRAWING

The FIGURE schematically illustrates a combination double ended tungsten halogen lamp mounted in a parabolic reflector lamp assembly by means of a long and a short mount wire welded to the outer leads of the lamp in accordance with the present invention.

DETAILED DESCRIPTION

The invention is not intended to be limited to a double ended lamp mounted in a reflector. The lamp can be mounted in any suitable mounting assembly including, but not limited to, a vitreous, light transmitting envelope such as fused silica or glass which, in turn, is mounted into a suitable reflector or luminaire. The invention more broadly relates to a double ended lamp mounted in a suitable mount by means of a long and a short mount wire welded to the molybdenum alloy outer lead wires of the lamp with the shorter mount wire being smaller in cross-section than the long mount wire, but not smaller in cross-section than the lamp lead to which it is welded, with the recrystallization temperature of the molybdenum lamp lead to which the short mount is welded being at least about 200° C. higher than molybdenum. Further, although the cross-section or diameter of the lamp lead and short mount wire can be the same, it is preferred that the diameter of the short mount wire be greater than the lamp lead, but smaller than that of the long mount wire.

Turning now to the FIGURE, lamp 10 is shown which comprises a tubular shaped, vitreous quartz envelope 12 containing filament 14 within a filament chamber 15 and having spuds 16 and 16' for centering the filament and attached at their respective opposite ends to molybdenum foils 18 for effecting a hermetic seal of the lamp. Outer leads 20 and 22 are shown connected at one end to the molybdenum foils 18 and at their other end to mount wires 24 and 26, respectively, which secure lamp 10 within parabolic reflector and lamp assembly 30. The longitudinal axis of lamp 10 is generally parallel to mount wire 24. However, it will be appreciated that mount wire 24 can be somewhat curved instead of straight.

In lamp 10, both of the tubular end portions of the lamp, 28 and 28', have been sealed over molybdenum foil members 18 to form a hermetic seal. Outer leads 20 and 22 extend past the end of tube portions 28 and 28' of lamp 10 and are welded to mount wires or legs 24 and 26 of the lamp. Lamp mount wires 24 and 26 will generally be made of nickel, iron or alloy thereof and preferably an alloy of nickel and iron and will generally range from about 20 to 90 mils in diameter. Such wire is commercially available for lamp manufacture as is known to those skilled in the art. Wire that has been found to be particularly useful in the practice of this invention for the mount wires is wire made of nickel and iron containing 52% nickel and 48% iron. This wire is commercially available from GE Lighting in Cleveland, Ohio. Lamp outer leads 20 and 22 are made of molybdenum alloyed to have a recrystallization temperature of at least about 200° C. higher than molybdenum and such wire suitable for use in this invention is commercially available as KW Mo wire from GE Lighting in Cleveland, Ohio. This type of wire has a relatively ductile, fibrous structure and has been used to make outer leads of lamps for a number of years. However, the invention resides in the combination of long and short lamp mount wires welded to the lamp outer leads with the lamp outer leads being molybdenum alloyed to have the higher recrystallization temperature and the short mount wire being no smaller in cross-section than the lamp lead to which it is welded and preferably intermediate in cross-section between the long mount wire and the lamp outer lead.

The seal may be a press or pinch seal or a shrink seal. Shrink seals are preferred, because deformation and misalignment of the tube portions of the lamp envelope are minimal with a shrink seal as compared to that which can occur with pinch sealing. Shrink seals are known to those skilled in the art and examples of how to obtain same are found, for example, in U.S. Pat. Nos. 4,389,201 and 4,810,932. The interior of filament chamber 15 contains an inert gas such as argon, xenon or krypton, along with minor (i.e., less than 10%) amounts of nitrogen, one or more halogen compounds such as methyl bromide, dibromomethane, dichlorobromethane and the like, and, optionally phosphorus, as is known to those skilled in the art. Alternatively, lamp 10 can be an arc lamp in which electrodes are enclosed at opposite ends of the chamber 15 instead of a filament.

Thus, the completed lamp and reflector assembly 30 contains lamp 10 mounted near the bottom portion of parabolic glass reflector 32 by means of the conductive mounting wires or legs 24 and 26 which project through holes 40 shown in partial form at the bottom portion 42 of glass reflector 32. Metal ferrules 44 are sealed into holes 40 by means of a glass to metal seal and mount wires 24 and 26 are brazed into the bottom of ferrules 44. Lamp base 50 is crimped onto the bottom portion of the glass reflector envelope by means not shown at neck portion 52. Screw base 60 is a standard screw base for screwing the completed assembly 30 into a suitable socket. Screw base 60 comprises metal sleeve 62 having screw threads and metal disc 64 separated by glass insulating portion 66. Sleeve 62 and disc 64 are separately electrically connected by means not shown to ferrules 44. Glass or plastic lens or cover 31 is attached or hermetically sealed by adhesive or other suitable means to the other end of reflector 32 to complete the lamp and reflector assembly.

In the embodiment shown in the FIGURE wherein the lamp is a filament containing lamp such as a tungsten halogen lamp, it is important that the resonant frequency of the lamp and mount assembly not overlap the resonant frequency of the filament in the lamp in either transverse or lateral motion, or the filament may break when the assembly is subjected to impact or vibration, as those skilled in the art know. However, one does not encounter this problem with an arc lamp which does not contain a filament.

DESCRIPTION OF A PREFERRED EMBODIMENT

A number of hermetically sealed lamp and reflector assemblies were made of the type depicted in the FIGURE wherein the lens was glass which was fused onto the glass reflector. The lamp was a 60 watt tungsten halogen lamp having an overall length from end to end (not including the outer leads) of about 47 ½ millimeters and weighing approximately 1.7 grams. Long lamp mount leg 24 was about 72 millimeters long from the bottom of the ferrule in which it was brazed to the bent top portion where it was resistance welded to the upper, outer lamp lead 20 and the shorter, bottom mount leg 26 was about 16 millimeters long in both its horizontal and vertical dimensions. Lower mount leg 26 was welded to lower outer lamp lead 22. The horizontal, bent over portions of mount legs 24 and 26 which were welded to the lamp outer leads, as shown in the FIGURE, were both about 16 millimeters long. The overall length of the lamp and reflector assembly was about 140 millimeters and the widest width across the top of lens was about 125 millimeters. The lamps were made employing an alloy comprising 52% nickel and 48% iron as the mount or support wires. The longer mounting leg or wire had a diameter of either 60 or 70 mils, depending upon the particular construction, whereas the lower support leg 26 had a diameter of either 40 or 60 mils. In addition, the molybdenum lamp outer leads 20 and 22 were either relatively pure molybdenum or the KW Mo molybdenum doped with Al, Si and K having a recrystallization temperature approximately 200° C. over that of the molybdenum wire that wasn't doped. The diameter of the outer lamp leads in all cases was 20 mil. A number of lamps were fabricated as test groups of from 43 to 59 lamps in each test group and subjected to a standard package drop test, which included six drops from 30 inches and vibration at about 1 g for an hour. The results are shown in the table below which illustrate the efficacy of the invention in which there were no broken lamps.

| Mount Wire Dia. (mils) (Long/Short) | LOWER LAMP LEAD FAILURES AFTER PACKAGE DROP TEST* Lamp Outer Lead Material | |
|---|---|---|
| | Mo | KW Mo |
| 60/60 | 4.7% (2/43) | 1.7% (1/59) |
| 60/40 | 15.1% (8/53) | 0% (0/58) |

-continued

| Mount Wire Dia. (mils) (Long/Short) | LOWER LAMP LEAD FAILURES AFTER PACKAGE DROP TEST* Lamp Outer Lead Material | |
|---|---|---|
| | Mo | KW Mo |
| 70/40 | 9.4% (5/53) | 0% (0/45) |

*Note: Numbers in parenthesis refer to number of lamp failures out of test group (i.e., 2/43 means 2 out of 43 lamps failed due to breaking of the lower lamp lead wire).

What is claimed is:

1. A double ended lamp and mount assembly wherein said lamp comprises a light transmissive envelope containing an electric light source within and having a molybdenum alloy outer lead wire projecting outwardly from each end of said lamp mounted in a suitable mount by means of a long and a short mount wire welded to respective ones of said molybdenum alloy outer lead wires of the lamp, with the shorter mount wire being smaller in cross-section than the long mount wire, but not smaller in cross-section than the lamp lead to which it is welded and with the recrystallization temperature of the molybdenum alloy lamp lead wire to which the short mount is welded being at least about 200° C. higher than molybdenum.

2. The assembly of claim 1 wherein said cross-section of said short mount wire is larger than that of said outer lamp lead to which it is welded.

3. The assembly of claim 1 wherein the longitudinal axis of said lamp is generally parallel to the longitudinal axis of said long mount wire.

4. The assembly of claim 2 wherein the longitudinal axis of said lamp is generally parallel to the longitudinal axis of said long mount wire.

5. The assembly of claim 1 wherein said lamp contains a filament.

6. The assembly of claim 4 wherein said lamp contains a filament.

7. The assembly of claim 6 wherein the resonant frequency of said lamp and mount wire assembly does not overlap the resonant frequency of said filament.

8. The assembly of claim 7 wherein said lamp is an incandescent filament lamp.

9. The assembly of claim 3 wherein said lamp is an arc lamp.

10. In combination, a double ended incandescent electric lamp assembled into a reflector wherein said lamp comprises a light transmissive envelope containing an electric light source comprising a filament within and having a molybdenum alloy outer lead wire electrically connected to said light source extending outwardly from each end thereof, wherein said lamp is mounted within said reflector by means of two mount wires, a long wire and a short wire each welded to respective ones of said molybdenum outer lamp lead wires, said lamp mounted in said reflector with its longitudinal axis about coincident with the longitudinal axis of both said reflector and said long mount wire, with said short mount wire being smaller in cross-section than said long wire but not smaller in cross-section than said outer lamp lead wire to which it is welded, said outer lamp lead wires having a recrystallization temperature at least about 200° C. higher than molybdenum.

11. The combination of claim 10 wherein said cross-section of said short mount wire is larger than that of said lead wire to which it is connected.

12. The combination of claim 11 wherein the resonant frequency of said lamp and mount wire assembly does not overlap the resonant frequency of said filament.

* * * * *